US007556330B2

(12) United States Patent
Saito et al.

(10) Patent No.: US 7,556,330 B2
(45) Date of Patent: Jul. 7, 2009

(54) RECORDING APPARATUS AND RECORDING METHOD

(75) Inventors: Tetsuya Saito, Yokohama (JP); Souhei Tanaka, Kawasaki (JP); Keiji Tomizawa, Yokohama (JP); Mineo Kaneko, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/559,705

(22) PCT Filed: Jun. 10, 2004

(86) PCT No.: PCT/JP2004/008493

§ 371 (c)(1),
(2), (4) Date: Oct. 11, 2006

(87) PCT Pub. No.: WO2004/110763

PCT Pub. Date: Dec. 23, 2004

(65) Prior Publication Data

US 2007/0057985 A1 Mar. 15, 2007

(30) Foreign Application Priority Data

Jun. 12, 2003 (JP) ..... 2003-167364
Jun. 7, 2004 (JP) ..... 2004-168658

(51) Int. Cl.
*B41J 29/38* (2006.01)

(52) U.S. Cl. ..... 347/14; 347/19; 347/35

(58) Field of Classification Search ..... 347/14, 347/15, 19, 41–43, 5–9, 16, 23, 35
See application file for complete search history.

(56) References Cited

U.S. PATENT DOCUMENTS

| | | | | |
|---|---|---|---|---|
| 5,659,342 | A * | 8/1997 | Lund et al. | 347/35 |
| 6,155,668 | A | 12/2000 | Otsuki et al. | |
| 6,709,088 | B2 | 3/2004 | Hayakawa et al. | |
| 6,752,494 | B2 | 6/2004 | Matsui | |
| 6,966,629 | B2 | 11/2005 | Nakajima et al. | |
| 7,159,960 | B2 * | 1/2007 | Nunokawa et al. | 347/14 |
| 2002/0101472 | A1 * | 8/2002 | Tsuboi et al. | 347/35 |

FOREIGN PATENT DOCUMENTS

| | | |
|---|---|---|
| JP | 11-291506 | 10/1999 |
| JP | 2002-86760 | 3/2002 |
| JP | 2002-326345 | 11/2002 |

* cited by examiner

*Primary Examiner*—Lam S Nguyen
(74) *Attorney, Agent, or Firm*—Fitzpatrick, Cella, Harper & Scinto

(57) ABSTRACT

In a recording apparatus using a recording head which can eject ink droplets having different sizes, a problem in which the recording image quality is decreased or mist is generated when the recording is performed on a predetermined area of a recording medium can be prevented. In the ink droplets having the different sizes, the size of the ink droplet used for the recording is set in accordance with the recording area to perform the recording based on the setting.

6 Claims, 12 Drawing Sheets

RECORDING APPARATUS AND RECORDING METHOD

TECHNICAL FIELD

The present invention relates to an inkjet recording apparatus which ejects ink to form an image and a method of forming the image in the inkjet recording apparatus, particularly to the inkjet recording apparatus and the image forming method which can eject ink droplets having different sizes.

BACKGROUND ART

In the recording apparatus for performing the recording to a recording medium such as paper or an OHP sheet, there has been proposed the recording apparatuses on which various types of recording heads are mounted. A wire-dot type, a thermal type, a thermal transfer type, and an inkjet type can be cited as an example of the recording heads. Particularly, since the inkjet type of recording is performed by directly ejecting the ink to recording paper, its running cost is low and its recording operation is quiet. Accordingly, it has attracted a great deal of attention.

In the inkjet recording apparatus, a multiplicity of nozzles (ejection ports or recording elements) for ejecting the ink droplets are formed in the recording head. The inside of the nozzles are filled with the ink for performing the recording to the recording medium. When characters, images, and the like are recorded, the recording is performed by selecting appropriately the corresponding nozzles to recording data (image data) from the nozzles to eject the ink. The method of converting heat, energy of a heater provided in the nozzles into ejection energy or the method of converting mechanical energy of an element generating vibration into the ejection energy can be cited as an example of the methods for ejecting the ink.

The inkjet recording apparatus includes a serial scan type (carriage scan type) inkjet recording apparatus and a multi-scan type inkjet recording apparatus. In the serial scan type inkjet recording apparatus, the carriage on which the recording head is mounted performs the recording while reciprocating in a direction substantially perpendicular to the direction in which the nozzles are arrayed in the recording head. In the multi-scan type recording apparatus, the recording is performed by using the recording head having a width substantially equal to the width of the recording medium. The serial scan type inkjet recording apparatus has a configuration in which, after the multiplicity of nozzles included in the recording head are driven based on recording information by the carriage scan to perform the recording of one scan recording area, the recording medium is relatively conveyed by a predetermined amount in the direction substantially perpendicular to the carriage reciprocating direction. The given image is formed by alternately performing the recording scan and the conveyance of the recording medium. In the multi-scan type recording apparatus, the image is formed by performing the recording while the recording medium is conveyed in the direction substantially perpendicular to a nozzle array disposed in the recording head.

Recently, as the inkjet recording apparatus becomes widespread, the high quality of the output image is required. In order to improve the image quality, it is effective to decrease graininess. Therefore, there has been proposed the technology which decreases the ink droplet ejected from the recording head to finely dispose the ink on the recording medium.

In order to finely dispose the ink on the recording medium, it is contemplated to increase a drive frequency of the recording head to shorten an interval of the ink ejection, or it is thought to array the nozzles in high density in the recording head. However, when the drive frequency of the recording head is excessively increased, after the ink droplet is ejected from the recording head, the next ink droplet cannot be ejected because the ink supply cannot catch up. Therefore, when it is desirable that the ink is disposed on the recording medium in a finer manner than the drive frequency determined by the configuration of the recording head, it is realized by the technology that the recording scan is performed at the ejectable drive frequency determined by the configuration of the recording head and the plural-time recording scans of the recording head are performed over the same recording area. In this case, it is necessary that the previous recording scan differs from the subsequent recording scan in ejection timing of the ink droplet from the recording head so that impact positions of the ink droplets are different from each other. However, while the ink can be finely disposed on the recording medium by performing the plural-time recording scans over the same recording area, throughput is decreased.

In order to solve the problem, there is the method in which the recording head which can eject both the ink droplet having a relatively larger volume and the ink droplet having a relatively smaller volume is used, the larger ink droplets are coarsely disposed on the recording medium in the case where the high-speed recording is required rather than the image quality, such as a case in text data, and the smaller ink droplets are finely disposed on the recording medium in the case where the image quality is required rather than the recording speed, such as a case in image data (e.g. a photograph), and thereby both the high-speed recording and the high-quality image become mutually compatible (for example, Japanese Patent Application Laid-Open No. 2002-086760). The method of changing the energy given to the ink during the ejection by controlling current or voltage applied to a heater or a piezoelectric element, or the method of arranging the nozzles for ejecting the relatively larger ink droplet and the nozzles for ejecting the relatively smaller ink droplet in the recording head can be cited as an example of the method of ejecting the ink droplets having the different sizes from the recording head.

(First Problem)

However, when the amount of shift of the impact position of the larger ink droplet is equal to that of the impact position of the smaller ink droplet on the recording medium, degradation of the image quality becomes conspicuous in the recording in which the smaller ink droplets are disposed in high density on the recording medium when compared with the recording in which the larger ink droplets are disposed in low density.

When the recording medium is conveyed while supported by both a conveying roller and a paper discharge roller, the recording medium can be conveyed with high accuracy. However, conveyance accuracy is decreased when the recording medium is conveyed while supported by only one of the conveying roller and the paper discharge roller, that is, immediately after paper feed of the recording medium or immediately before paper discharge. Specifically, a front end area in advance of arrival of a front end of the recording medium at the paper discharge roller and a rear end area subsequent to separation of a rear end of the recording medium from the conveying roller are the area where the conveyance accuracy is decreased. Therefore, the impact positions of the ejected ink droplets are shifted in each of the front end area and the rear end area of the recording medium, which results in the degradation of the image quality.

Accordingly, in the front end and rear end areas of the recording medium where the conveyance accuracy is decreased, when the printing is performed while the smaller ink droplets are disposed in high density, there is the problem that the image quality failure such as unevenness is particularly easy to occur.

(Second Problem)

In the image of the inkjet recording apparatus, as the resolution and quality are improved, a range of application is increased and various modes of forming the image on the recording medium are demanded. For example, when the image taken by a digital camera or the like is output with the inkjet recording apparatus, the output result similar to the photograph output to a photographic paper, i.e. the so-called frameless recording is performed by recording the image on the whole surface of the recording medium without providing a margin in a peripheral portion of the recording medium. The frameless recording is realized by ejecting the ink droplets in the range wider than the recording medium. The inside of the recording apparatus is prevented from becoming soiled by providing a member for absorbing the ink (ink absorber), at the position in the area outside the recording medium, where the ink is ejected.

Sometimes the ink droplet does not reach the surface of the recording medium or the surface of the ink absorber but become mist to diffuse inside the recording apparatus by evaporating the ejected ink droplet before the ink droplet reaches the recording medium or the ink absorber. Because the distance from the nozzle surface of the recording head to the surface of the ink absorber is longer than the distance from the nozzle surface of the recording head to the surface of the recording medium, the mist is easy to generate when the ink droplet is ejected in the area outside the recording medium. Further, because heat capacity is smaller in the ink droplet having the smaller volume, the ink droplet having the smaller volume is easy to evaporate when compared with the ink droplet having the larger volume, and the generation of the mist is increased when the recording is performed with the ink droplet having the smaller volume.

Therefore, when the recording is performed with the ink droplet having the smaller volume in the area outside the recording medium, the mist is easiest to generate. When the mist diffuses inside the recording apparatus, the recording medium becomes soiled by the mist adhering to the conveying roller or the operation of the carriage is obstructed by the mist adhering to a guide shaft. Further, when an optical encoder is used in order to control the moving speed and the position of the carriage and the recording medium, because the ink mist cut off light, the normal control can not be performed. Therefore, sometimes various problems are generated in the recording apparatus such that the speed control or stop position control becomes abnormal.

DISCLOSURE OF THE INVENTION

In view of the foregoing, the present invention can improve the decrease in image quality when the recording is performed on the predetermined recording area in the inkjet recording apparatus which can eject ink droplets having different sizes.

The invention can also decrease the generation of mist when recording is performed on the predetermined recording area.

A recording apparatus of the invention for recording an image on a recording medium by using a recording head which can form dots with a plurality of dot diameters, the recording apparatus comprising deciding means for deciding an area where the recording head ejects the ink in a recording area including the recording medium and recording controlling means for making change so as to decrease ejection frequency of the dot formed by the relatively smaller dot diameter in the plurality of dot diameters when the deciding means decides that the recording head ejects the ink in the area near an end portion of the recording medium.

A recording apparatus of the invention for performing recording on a recording medium based on image data by using a recording head which can eject ink droplets having different volumes, the recording apparatus comprising deciding means for deciding an area where the recording is performed in a recording area by the recording head, setting means for setting each of ratios of recordings by the ink droplets having different volumes in accordance with a decision result of the deciding means, and recording means for performing the recordings by the ink droplets having different volumes with the ratios set by the setting means.

A recording method of the invention in a recording apparatus for recording an image on a recording medium by using a recording head which can form dots with a plurality of dot diameters, the recording method comprising a decision step of deciding an area where the recording head ejects the ink in a recording area including the recording medium, a change step of making change so as to decrease ejection frequency of the dot formed by the relatively smaller dot diameter in the plurality of dot diameters, when, in the decision step, it is decided that the recording head ejects the ink in the area near an end portion of the recording medium, and a recording step of forming the dot at the ejection frequency changed by the change step.

A recording method of the invention in a recording apparatus for performing recording to a recording medium based on image data by using a recording head which can eject ink droplets having different volumes, the recording method comprising a decision step of deciding an area where the recording is performed in a recording area by the recording head, a setting step of setting each of ratios of recordings by the ink droplets having the different volumes in accordance with decision result in the decision step, and a recording step of performing the recordings by the ink droplets having the different volumes with the ratios set by the setting step.

According to the invention, in the inkjet recording apparatus which can eject ink droplets having different sizes, since the recording is properly performed with the ink droplet having a predetermined size in accordance with the recording area including the recording medium, the quality of the recording image can be improved. Further, the generation of the mist can be reduced.

BEST MODE FOR CARRYING OUT THE INVENTION

First Embodiment

Referring to the accompanying drawings, preferred embodiments of the invention will be specifically described.

Figure 2:
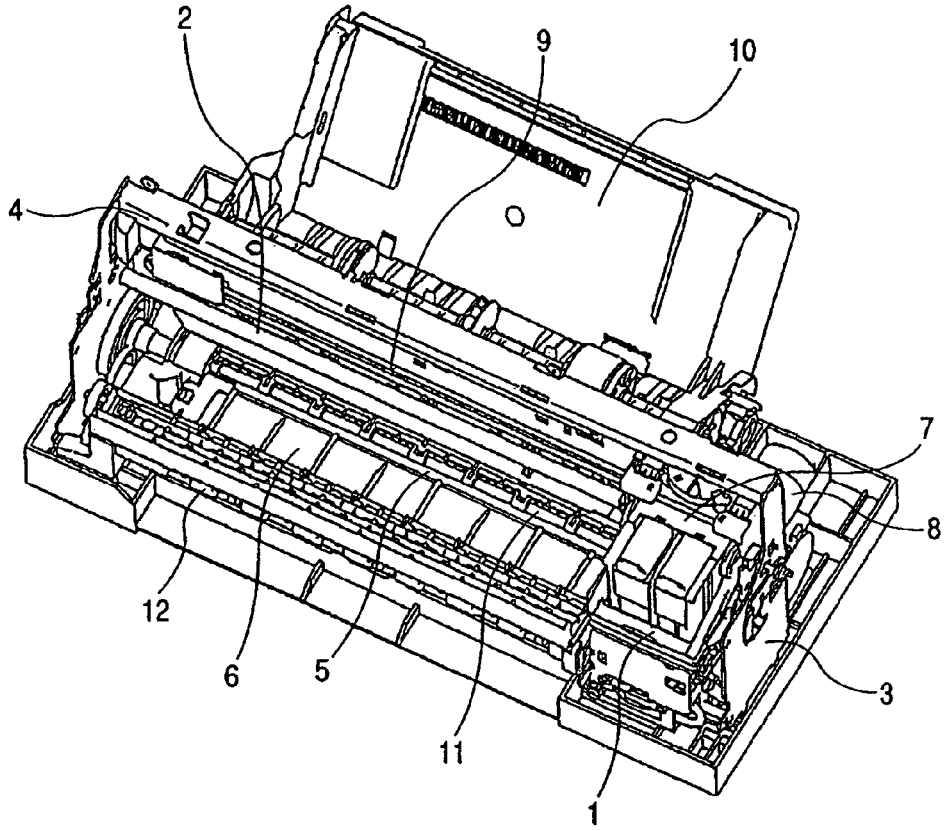
FIG. 2 is a schematic diagram showing a configuration of an inkjet recording apparatus.

FIG. 2 is a schematic diagram showing a configuration of the inkjet recording apparatus to which the invention can be applied.

A carriage 1 is supported by a guide shaft 2 and a guide rail 4 so that the carriage can be reciprocated while opposed to a conveying roller 5 and a platen 6 which are held by a chassis 3. A recording head 7 is mounted on the carriage 1 to be reciprocated along the guide shaft 2 by utilizing drive force of a carrier motor 8 which is transmitted through a belt 9. The recording medium 13 is fed to a nip formed between the conveying roller 5 and an auxiliary roller 11 by a paper feed unit 10, and the recording medium is conveyed to a predetermined printing position by the conveying roller 5. When a front end of the recording medium reaches a paper discharge roller 12, the recording medium is conveyed by the conveying roller 5, the auxiliary roller 11, and the paper discharge roller 12 while stably held.

When a predetermined area of the recording medium is conveyed to the position opposite to the recording head 7, the ink is ejected toward the recording medium by driving the recording head 7 in accordance with recording data transmitted to the inside of the printer while the carriage 1 is moved along the guide shaft 2, and thereby the image is formed in accordance with the recording data. When one recording scan of the recording head is finished, the conveying roller 5 is rotated by the predetermined amount to convey the recording medium so that the area of the recording medium where the next recording should be performed is moved to the position opposite to the recording head 7. After the conveying operation of the recording medium is finished, the carriage 1 performs the recording of the next line by performing the recording scan again. When the predetermined amount of recording data is completely recorded by repeating a series of operations, the recording medium is discharged to the outside of the recording apparatus by the paper discharge roller 12 to complete the recording.

Figure 3A:
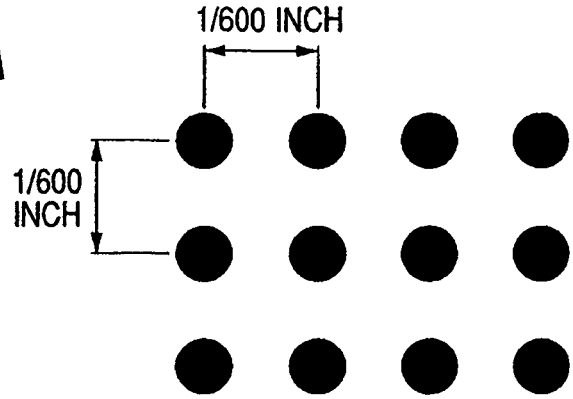
FIGS. 3A, 3B, and 3C are schematic views of an ink dot array of larger dots, smaller dots, and a mixed pattern respectively.
Figure 3B:
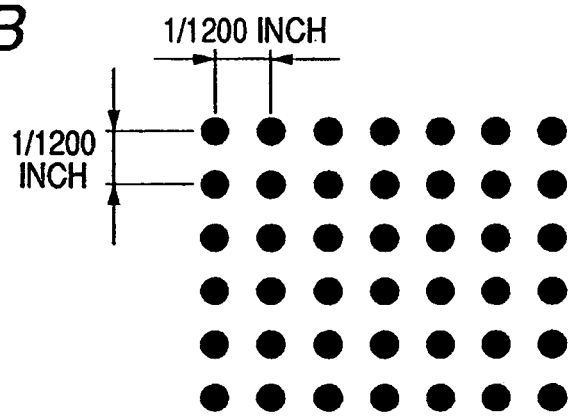
Figure 3C:
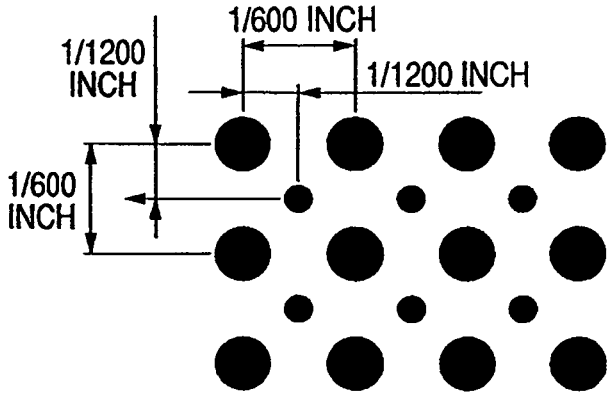

FIGS. 3A to 3C show the ink droplets ejected from the recording head in the embodiment.

FIG. 3A shows the case in which the larger ink droplets are ejected. The ink droplets are arrayed with a pitch of 1/600 inch (42 μm) so that a dot diameter becomes 30 μm on the recording medium. FIG. 3B shows the case in which the smaller ink droplets are ejected. The ink droplets are arrayed with a pitch of 1/1200 inch (21 μm) so that the dot diameter becomes 15 μm on the recording medium. In comparison between FIG. 3A and FIG. 3B, because FIG. 3B is smaller than FIG. 3A in the dot diameter, graininess of FIG. 3B is inconspicuous and high-quality recording result is obtained.

FIG. 3C shows the case in which the ink droplets having the different diameters are ejected. By forming the smaller dots in the larger dots, the recording can be performed with intermediate quality between FIG. 3A formed only by the larger ink droplet and FIG. 3B formed only by the smaller ink droplet. In FIG. 3C, not only the image quality can be improved when compared with the image formed only by the larger dots, but also the recording speed can be increased when compared with the image formed only by the smaller dots, so that the decrease in throughput can be suppressed As an example of the recording head to which the embodiment can be applied, the recording head in which a plurality of nozzles (recording element, ejecting port) capable of independently ejecting ink droplets by utilizing heat or vibration is arrayed can be cited. It is also possible to provide a plurality of nozzle arrays in which the nozzles are arrayed for each color of the ink. It is also possible to use the recording head in which one nozzle can eject the ink droplets having different sizes. It is also possible to use the recording head in which at least two types of nozzles are disposed so that one of the types of nozzles can eject the ink droplets having the predetermined size and the other type of nozzles can eject the ink droplets having the size different from the predetermined size.

Figure 4:
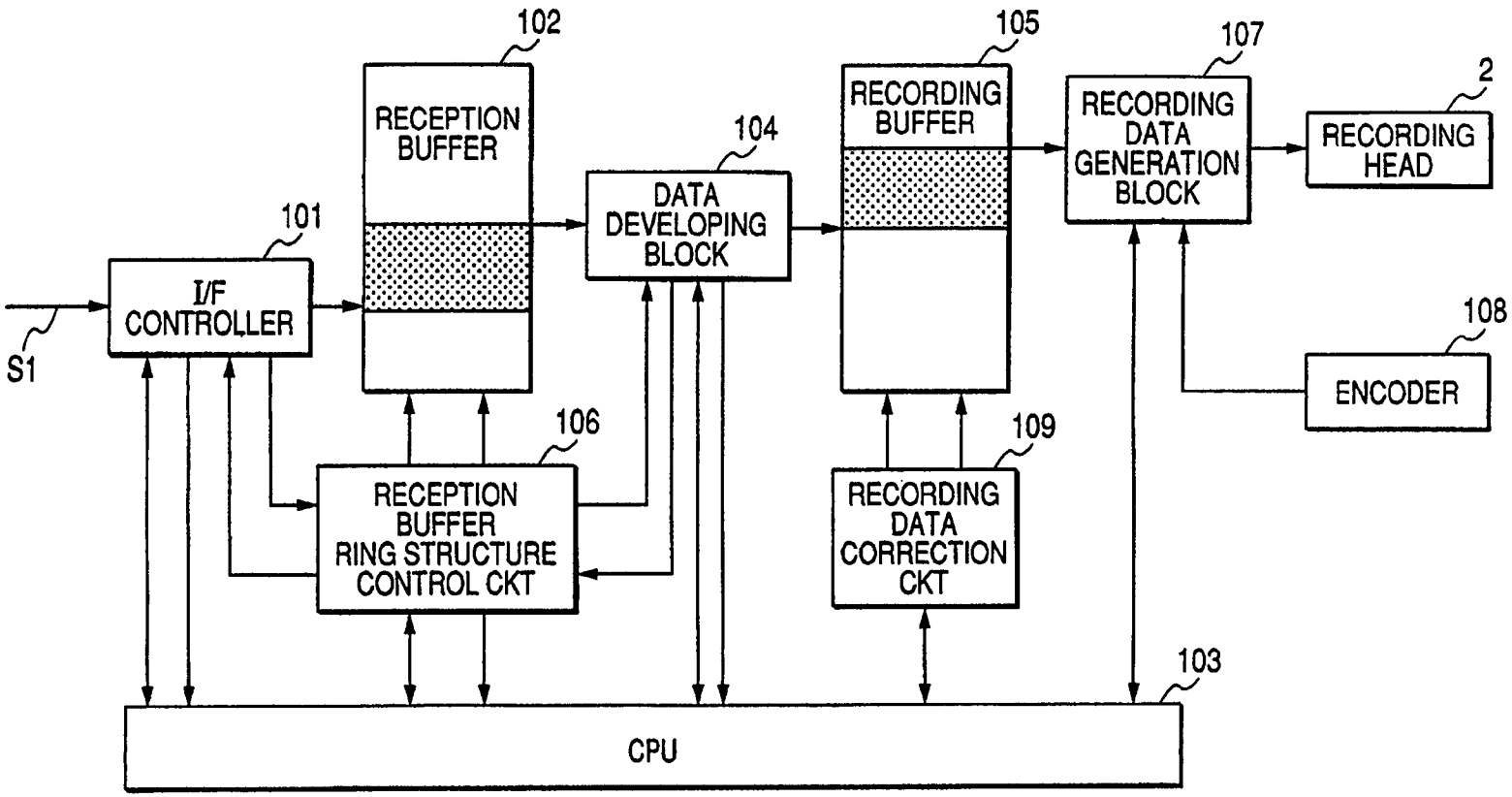
FIG. 4 is a block diagram showing a recording control unit of the inkjet recording apparatus.

FIG. 4 is a block diagram showing a recording control unit of the inkjet recording apparatus to which the embodiment can be applied.

The reference numeral 101 represents an interface control unit (controller). The interface control unit receives the data transmitted from a host computer (not shown) through an interface signal line S1 and extracts the data necessary for the operation of the recording apparatus and the image data from the received data to tentatively contain the data. The data extracted by the interface controller 101 is stored in a reception buffer 102 including a storage memory such as SRAM or DRAM. The data stored in the reception buffer 102 includes "command" which is of a set value for controlling the recording medium and "image data" which should be recorded. The "command" is read out by CPU 103 to perform analysis. In the "image data," the compressed image data is decompressed by a data developing block 104 and written in a recording buffer 105. It is also possible that the recording buffer 105 includes the storage memory such as SRAM or DRAM and the recording buffer 105 is physically equal to the reception buffer 102. A ring structure control circuit 106 manages data write address and data read address to the reception buffer 102. In the recording buffer 105, the decompressed image data is divided and disposed for each color of the recording heads and for each ink diameter.

When the recording buffer 105 is filled with the image data which can be recorded by one scan of the recording head, CPU 103 operates the carriage motor 8, of FIG. 2 to scan the recording head 7 in order to start the recording operation, a recording data generation block 107 synchronizes output from a carriage encoder (CR encoder) 108 and reads out the image data from the recording buffer 105 to transmit the image data to the recording head 7, and the recording head 7 ejects the ink droplet based on the transmitted image data. This enables the image to be formed on the recording medium. The image is completed on the recording medium by repeating the recording scan in a main scanning direction with the recording head and the conveyance of the recording medium in a sub-scanning direction with the conveying means.

Figure 1:
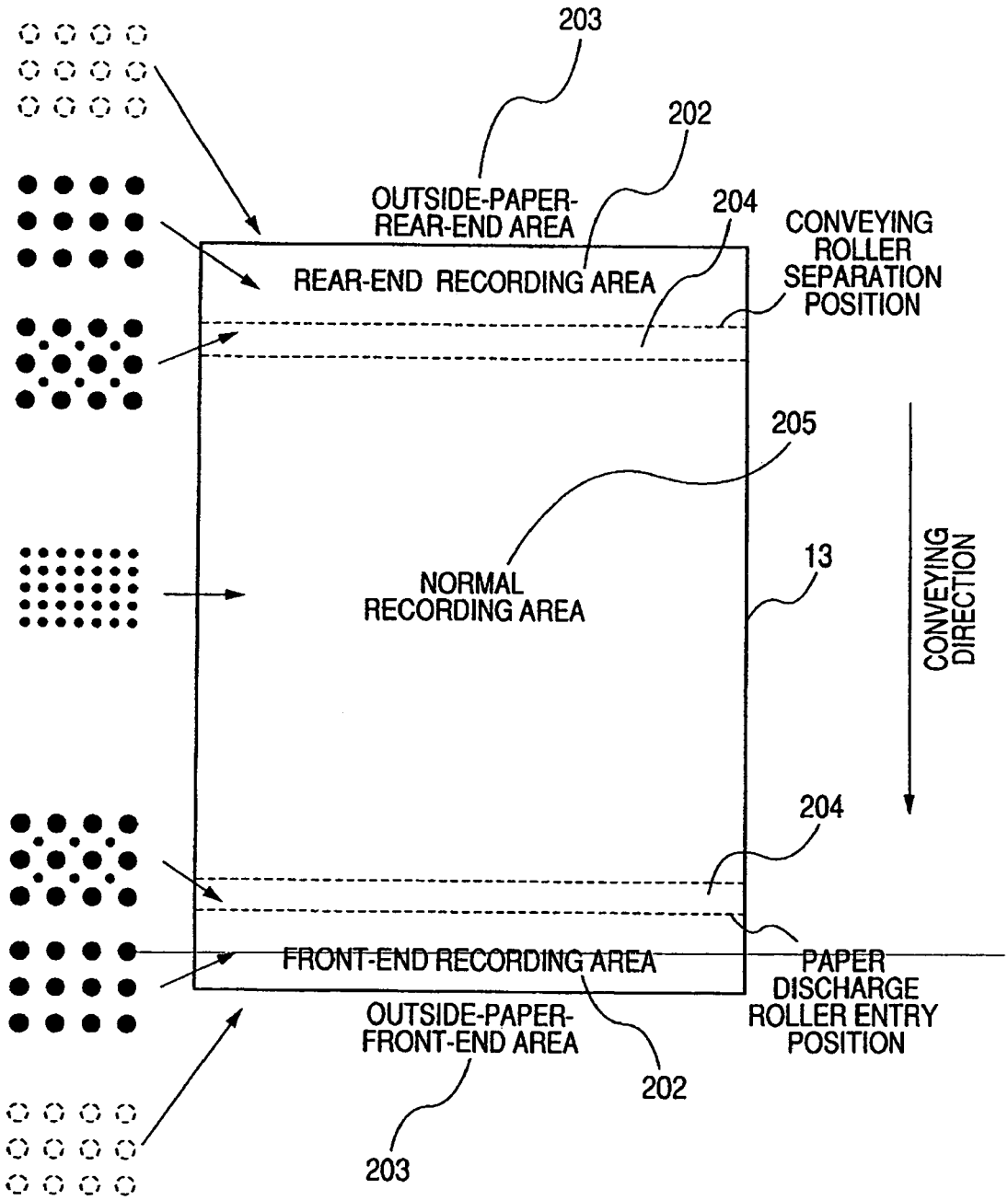
FIG. 1 is a schematic diagram showing an example of a recording method in a first embodiment.

FIG. 1 is a schematic diagram showing an example of the recording method in the first embodiment.

The recording area including a recording medium 13 is divided into the areas as shown in FIG. 1. The reference numeral 203 represents an area outside recording medium (areas outside paper). Particularly, the downstream side in the conveying direction is referred to as an outside-paper-front-end area because the downstream side is located close to the front end portion of the recording medium, and the upstream side in the conveying direction is referred to as an outside-paper-rear-end area because the upstream side is located close to the rear end portion of the recording medium. The reference numeral 202 represents a recording area of an end portion in the conveying direction of the recording medium, and the reference numeral 202 also represents the area which is not supported by both the conveying roller and the paper discharge roller in conveying the recording medium. The front end portion of the recording medium is referred to as a front-end recording area 202 and the rear end portion of the recording medium is referred to as a rear-end recording area 202. The reference numeral 204 represents an area where the conveyance only with the conveying roller is transferred to the conveyance with both the conveying roller and the paper discharge roller at the front end portion of the recording medium, and the reference numeral 204 also represents the area where the conveyance with both the conveying roller and the paper discharge roller is transfeffed to the conveyance only with the conveying roller at the rear end portion of the recording medium. The area 204 located on the front end side of the recording medium is the area which is spread from a paper discharge roller entry position where the recording medium conveyed only with the conveying roller is started to be supported by both the conveying roller and the paper discharge roller to the position where the recording medium is conveyed by a predetermined distance. The area 204 located on the rear end side of the recording medium is the area which is spread from the position where the recording medium is supported by both the conveying roller and the paper discharge roller to a conveying roller separation position where the rear end portion of the recording medium is separated from the conveying roller when the recording medium is conveyed by a predetermined distance. Further, the reference numeral 205 is a normal recording area between the areas 204.

The method of performing the recording to the recording medium shown in FIG. 1 in performing the high-quality recording will be described.

While the recording medium is conveyed with the conveying roller, the recording head is controlled so as not to perform the recording in the outside-paper-front-end area 203 where the recording is performed outside the recording medium when the recording operation is performed by the recording head. Specifically the control is performed so that the ink droplet is not ejected from the recording head. Therefore, the recording is not performed in the area outside the recording medium, which allows the inside of the recording apparatus to be prevented from becoming soiled by the ink.

In the front-end recording area 202 where the front end portion of the recording medium conveyed with the conveying roller reaches the recording area of the recording head, the recording is controlled so as to use only the larger ink droplet in which the decrease in image quality caused by shift of an impact position is inconspicuous because conveyance accuracy of the recording medium is low. Specifically, using the ink droplet having the size so that the dot diameter becomes 30 μm on the recording medium, the recording is performed based on the image data with the image quality in which the dots are arrayed with the 1/600 (42 μm) pitch.

In the area 204 in which the front end of the recording medium reaches the paper discharge roller and the recording medium is conveyed with both the conveying roller and the paper discharge roller by the predetermined distance, because the conveyance accuracy of the recording medium is improved when compared with the front-end recording area 202, the recording is performed while the larger ink droplet having the dot diameter of 30 μm and the smaller ink droplet having the dot diameter of 15 μm are mixed together. In FIG. 1, the recording is performed so that the ink droplets having the different sizes are arrayed in the different positions with each 1/600 (42 μm) pitch.

In a normal recording area 205 where the recording medium is stably conveyed with the conveying roller and the paper discharge roller, the recording is performed only by using the smaller ink droplet so that the image data is recorded with high quality. Specifically, using the ink droplet having the size so that the dot diameter becomes 15 μm on the recording medium, the recording is performed based on the image data with the image quality in which the dots are arrayed with the 1/1200 (21 μm) pitch. Therefore, in the normal recording area 205, the graininess is inconspicuous and the high-quality recording result is obtained by performing the recording with the smaller ink droplet. In the area 204 between the front-end recording area 202 where the recording is performed, only with the larger ink droplet and the normal recording area 205 where the recording is performed only with the smaller ink droplet, the transition from the front-end recording area 202 to the normal recording area 205 can be performed while the difference in image quality becomes inconspicuous by providing the area in which the recording is performed by mixing the larger ink droplet and the smaller ink droplet.

In the area 204 which is spread from the position where the recording medium is stably conveyed to the position where the recording medium is separated from the conveying roller, similarly to the area 204 including the paper discharge entry position, the recording is performed with the larger ink droplet and the smaller ink droplet. In the rear-end recording area 202 where the rear end portion of the recording medium conveyed by the paper discharge roller is located within the recording area of the recording head, similarly to the front-end recording area 202, the recording is performed only with the larger ink droplet. In the outside-paper-rear-end area 203 where the rear end portion of the recording medium is conveyed by the paper discharge roller beyond the recording area of the recording head, similarly to the outside-paper-front-end area 203, the recording head is controlled so as not to perform the recording.

As described above, the recording is performed with the relatively smaller ink droplet in order to perform high-quality recording with the graininess inconspicuous in the normal recording area 205 which occupies a dominant portion of the recording area on the recording medium, and the recording is performed with the relatively large ink droplet so that unevenness caused by fluctuations of the dot array by the shift of the impact position becomes inconspicuous although the graininess is slightly inferior in the front/rear-end recording area 202 of the recording medium where the conveyance accuracy is relatively worsened. Therefore, the high-quality recording result can be obtained in the whole image recorded in the recording medium.

The step of generating the recording data for ejecting the ink droplets having the different sizes from the image data transmitted from the host computer to the recording apparatus will be described below.

The image data transmitted from the host computer to the recording apparatus is stored in the recording buffer. At this point, the image data transmitted from the host computer has a possibility that the image data has the area larger than the recording area on the recording medium, and the image data in the recording buffer is divided into four areas 202, 203, 204 and 205 shown in FIG. 4. Then, it is decided whether a recording data correction circuit 109 corrects the image data divided into each of areas in the recording buffer to eject the larger ink droplet or the smaller ink droplet.

When the image quality has the higher priority to perform the high-quality recording, i.e. when the data is generated in the recording buffer so that the recording is performed only with the smaller ink droplet based on the image data transmitted from the host computer, the correction is performed by the recording data correction circuit 109 in the outside-paper-front/rear-end area 203, the front/rear-end recording area 202 and the area 264, while the correction is not performed by the recording data correction circuit 109 so that the recording area is performed only with the smaller ink droplet in the normal recording area 205.

Figure 5:
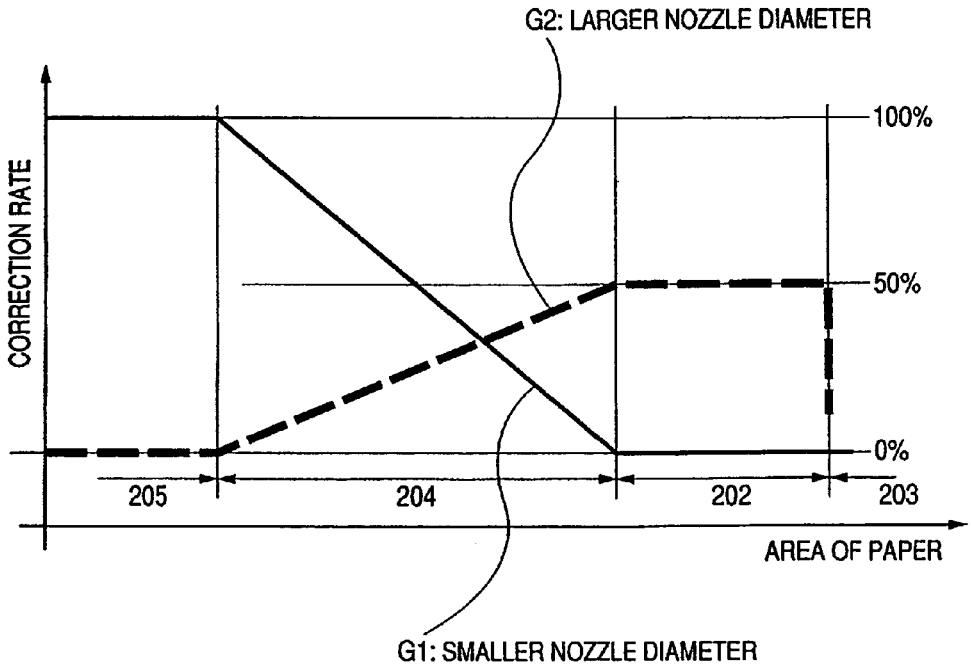
FIG. 5 shows ratios recorded by a larger ink droplet and a smaller ink droplet in each area in the first embodiment.

FIG. 5 shows ratios recorded by the larger ink droplet and the smaller ink droplet in the range from the normal recording area to the outside-paper-front/rear-end area 203. A solid line (G1) indicates the ratio recorded by the smaller ink droplet and a broken line (G2) indicates the ratio recorded by the larger ink droplet.

At the beginning of the area 204 which is of a boundary portion between the normal recording area 205 and the area 204, the recording is performed with the smaller ink droplet based on the recording data in the recording data, and the recording is not performed with the larger ink droplet. As the recording area approaches to the front/rear-end recording area 202 from the area 204, the ratio of the recording by the smaller ink droplet is decreasing and the ratio of the recording by the larger ink droplet is increasing. As shown in FIG. 5, the ratio between the recording by the larger ink droplet and the recording by the smaller ink droplet is changed in accordance with the position within the area 204. That is, in the embodiment, an appearance probability of the smaller ink droplet is linearly changed so as to be set to 100% (recording data is directly ejected) at the beginning of the area 204 and to be set to 0% (recording data is not ejected) at the end of the area 204 (near the end portion of the paper) which is of the boundary portion between the area 204 and the front/rear-end recording area 202. Further, the appearance probability of the larger ink droplet is linearly changed so as to be set to 0% at the beginning of the area 204 and to be set to 50% at the end of the area 204.

The reason why the appearance probability of the larger ink droplet is set to 50% at the end of the area 204 in performing the correction to the recording data for ejecting the larger ink droplet is that a volume of one larger ink droplet is set to 4 pl, the volume of one smaller ink droplet is set to 2 pl, and the 100% recording only by the smaller ink droplet is equal to the 50% recording only by the larger ink droplet in density.

The correction is performed by the recording data correction circuit 109 so that the recording is always performed only by the larger ink droplet in the front/rear-end recording area 202. Specifically, the appearance probability of the smaller ink droplet is set to 0% and the appearance probability of the larger ink droplet is set to 50%. In the outside-paper-front/rear-end area 203, the correction is performed so that whether the recording by the larger ink droplet or the recording by the smaller ink droplet is not performed at any time. Specifically, the appearance probability of each of the larger and smaller ink droplets is set to 0% so that each of the larger and smaller ink droplets is not ejected.

According to the embodiment, the high-quality image can be output in the inkjet recording apparatus which can eject the ink droplets having the different sizes, because the size of the ink droplet is selected in the recording in response to the recording image quality depending on the configuration of the recording apparatus such that the conveyance accuracy is decreased. Therefore, the decrease in image quality caused by the shift in the impact position can be suppressed to the minimum when the high-quality image is output.

Since the recording of the high-quality image has the higher priority in the embodiment, the recording is performed by using only the smaller ink droplet in the normal recording area 205. However, it is possible that the recording is performed by using the plurality of ink droplets having the different sizes in the normal recording area 205. This allows the recording apparatus having both the high-quality image and the high-speed recording to be provided. In this case, the ratio of the recording by the larger ink droplet is increased in the range from the normal recording area 205 to the area 204 or the front/rear-end recording area 202.

In the embodiment, the ratio between the recording by the larger ink droplet and the smaller ink droplet is linearly changed in the area 204. However, it is also possible that the ratio is changed in a step manner. In this case, the correction by the recording data correction circuit can be simplified.

Although the area 204 for the transition is provided between the normal recording area 205 and the front/rear-end recording area 202 so that the difference in image quality becomes inconspicuous in the embodiment, it is possible that the area 204 is not provided when the difference in image quality is not so conspicuous, or when the recording speed slightly has the higher priority.

Although the embodiment has the configuration in which the two types of sizes of the larger ink droplet and the smaller ink droplet are ejected, the invention can be also applied to the recording apparatus which ejects at least three types of ink droplet sizes.

Although the ratio between one smaller ink droplet and one larger ink droplet is set to 1:2 in the recording density in the embodiment, needless to say, the recording density can be set in each recording apparatus.

Second Embodiment

While the first embodiment has the configuration in which the size of the ink droplet used for recording is selected based on the decrease in image quality caused by the decrease in conveyance accuracy in the front-end and rear-end recording areas in the recording medium, a second embodiment has the configuration in which the size of the ink droplet used for the recording is selected in order to decrease the generation of mist in performing the recording in the vicinity of the end portion of the recording medium.

Figure 6:
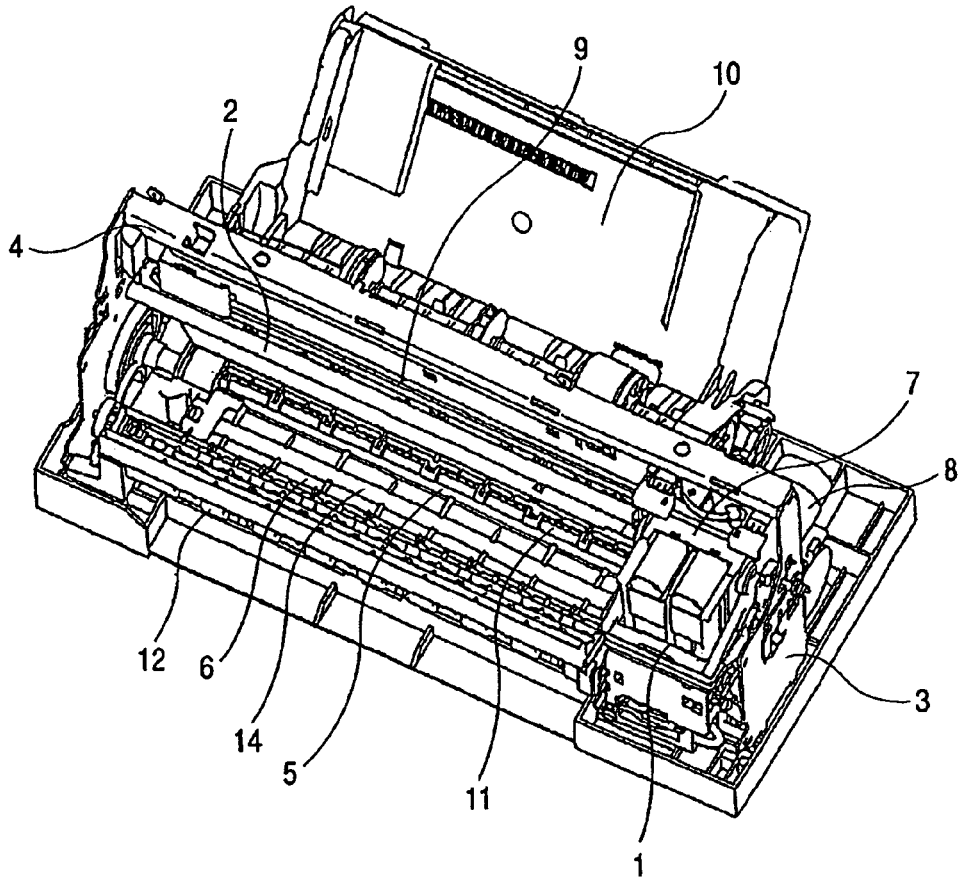
FIG. 6 is a schematic diagram showing the configuration of the inkjet recording apparatus in a second embodiment of the invention.

FIG. 6 is a schematic diagram of the inkjet recording apparatus to which the second embodiment can be applied.

The same component as the recording apparatus in the first embodiment is indicated by the same reference numeral. In FIG. 6, the recording apparatus is one in which the recording can be performed so that a margin of the recording medium is eliminated, and the recording apparatus includes an ink absorber 14.

Figure 7:
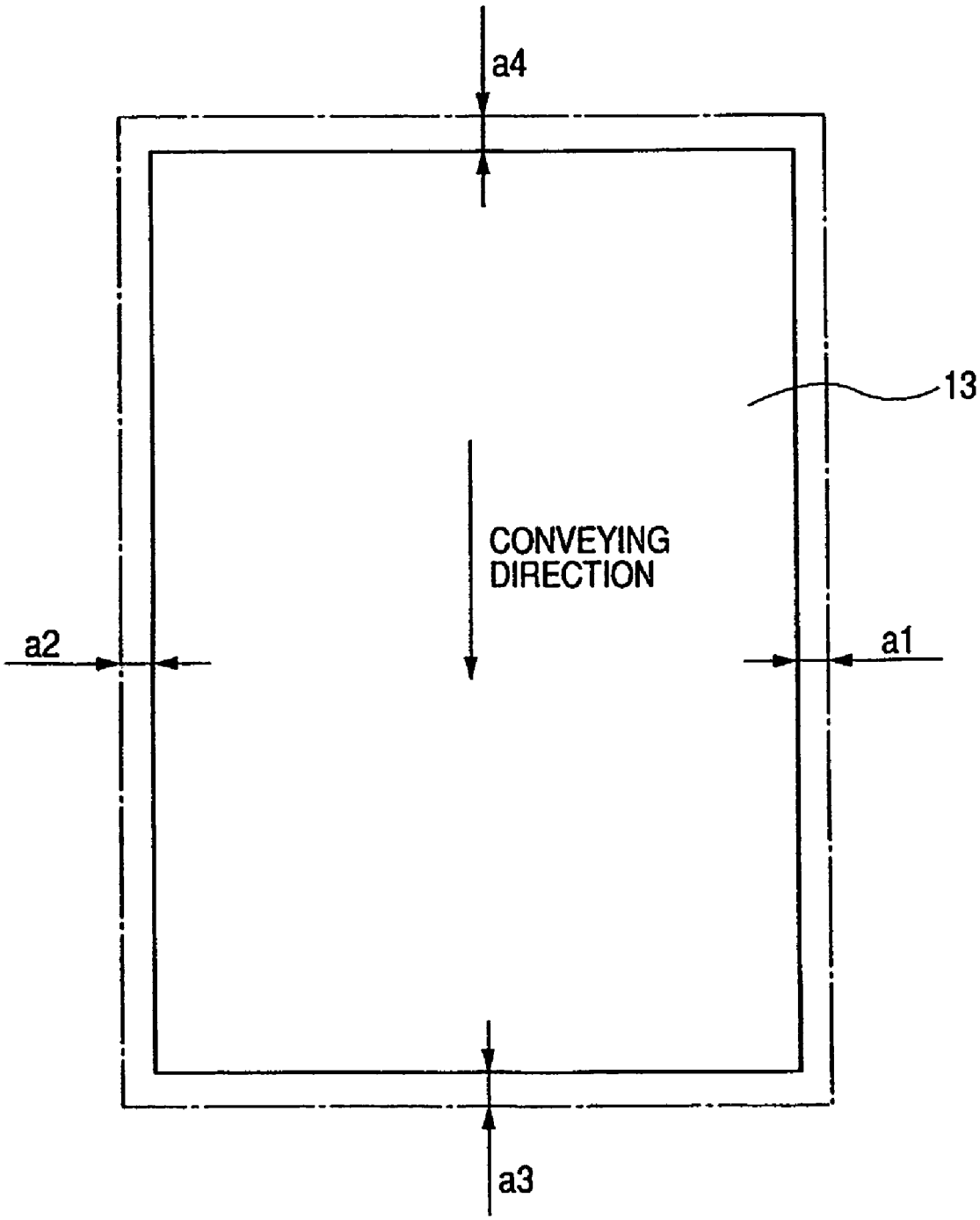
FIG. 7 shows a recording medium and a recording area in frameless recording.

FIG. 7 shows the recording medium and the recording area when the recording is performed so that the margin is eliminated.

The area shown by a chain double-dashed line outside the recording medium 13 is the recording area. As shown in FIG. 7, when the recording is performed so that the margin of the recording medium is eliminated, the recording is performed to the range which is wider than the recording medium by the predetermined amount (a1 to a4 are referred to as the amount of extending-off-recording medium). Usually the amounts of extending-off-recording medium a1 to a4 range from about 2 mm to about 5 mm.

The recording medium 13 is fed to the nip formed between the conveying roller 5 and the auxiliary roller 11 by the paper feed unit 10, and the recording medium 13 is conveyed to the position providing a predetermined amount of extending-off-recording medium a3 by the conveying roller 5. Under this condition, the recording head 7 is driven to eject the ink droplet toward the recording medium 13, the ink droplets ejected to the portions extending off the recording medium 13 reach onto the ink absorber 14 to be absorbed. Then, similarly to the normal recording, the recording is performed by repeating the conveying operation of the recording medium by the predetermined amount and the recording scan by the recording head. In each recording scan, both end portions of the recording area are recorded with the widths being wider than the recording medium 13 by a1 and a2. Similarly to the ink droplets ejected to the portion extending off the recording medium 13, the ink droplets ejected within the ranges extending off both end portions of the recording medium 13 are absorbed into the ink absorber 14. After the rear end of the recording medium 13 reaches the nozzle line of the recording head 7, the printing is continued to the range of the amount of extending-off-recording medium a4. Similarly to the recording of the front end portion, the ink droplets ejected to the portion extending off the recording medium 13 are also absorbed into the ink absorber 14. When the recording operation to the amount of extending-off-recording medium is finished, the recording medium 13 is discharged outside the printer, and the frameless recording in which the margin of the recording medium is eliminated is completed.

Even if the error is generated in conveying the recording medium or the recording medium is obliquely conveyed, the frameless recording in which the margin of the recording medium is eliminated can be securely performed by performing the recording operation to the range larger than the recording medium.

Figure 8:
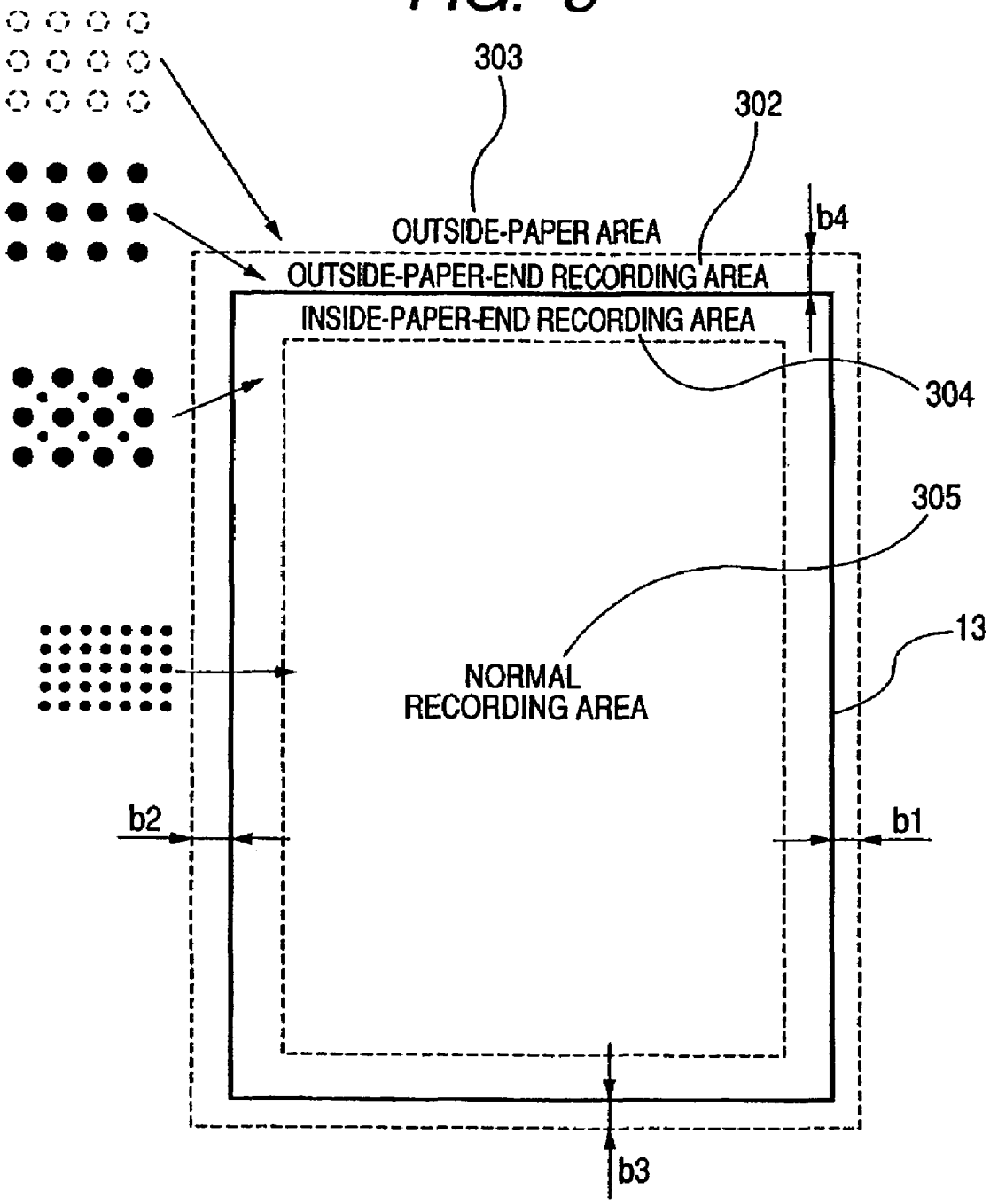
FIG. 8 is a schematic diagram showing an example; of the recording method in the second embodiment.

FIG. 8 is a schematic diagram showing the recording method in the embodiment.

The recording area including the recording medium 13 is divided into the areas as shown in FIG. 8. The reference numeral 305 represents the normal recording area of the central portion of the recording medium. The reference numeral 304 represents an inside-paper-end recording area which is located in a periphery within the recording medium. The reference numeral 302 represents an outside-paper-end recording area in the vicinity of the recording medium. The outside-paper-end recording area 302 is located outside the recording medium, and the outside-paper end portion recording area corresponds to the areas of the amounts of extending-off-recording medium b1 to b4. When the frameless recording is performed, the recording operation is also performed to the outside-paper end recording area 302. The reference numeral 303 represents an outside-paper area, which is located outside the outside-paper-end recording area 302 and largely extend off the recording medium.

The recording method in performing the frameless recording to the recording medium shown in FIG. 8 will be described below.

When the recording medium is conveyed and the recording operation is performed by the recording head, if it is decided that the recording is to be performed to an area outside the outside-paper-end recording area 302, that is, the outside-paper area 303, the recording head is controlled so as not to perform the recording.

When the recording is performed in order to eliminate the margin of the recording medium, if it is decided that the recording is to be performed to an area outside the recording medium, that is, the outside-paper-end recording area 302, the recording head is controlled so as to perform the recording only with the larger ink droplet in order to suppress the generation of the mist. When the recording is performed with the smaller ink droplet which is easy to evaporate, because the distance between the nozzle surface of the recording head and the ink absorber is larger than the distance between the nozzle surface and the recording medium, there is a fear that the smaller ink droplet does not reach the ink absorber but becomes mist to diffuse in the recording apparatus. Therefore, the recording is performed only with the larger ink droplet when the recording is performed in the recording area (outside-paper-end recording area 302) outside the recording medium.

When it is decided that the recording is to be performed to the inside-paper-end recording area 304 which is of the periphery of the recording medium, the recording is performed by mixing the larger ink droplet with the smaller ink droplet. In the embodiment, the ratio between the recording by the larger ink droplet and the recording by the smaller ink droplet is gradually changed in accordance with the position within the inside-paper-end recording area 304. This allows the image quality to be improved.

In the normal recording area 305, the recording is performed only with the smaller ink droplet so that the image data can be recorded in high quality. In performing the recording scan in the normal recording area 305, both end portions of each recording scan also include the inside-paper-end recording area 304, the outside-paper-end recording area 302, and the outside-paper area 303, so that the recording head is controlled so as to eject the ink droplet set in accordance with each area. In the inside-paper-end recording area 304 between the normal recording area 305 where the recording is performed only with the smaller ink droplet which is more likely to generate the mist and the outside-paper-end recording area 302 where the recording is performed only with the larger ink droplet which is less likely to generate the mist, when the dot arrangement pattern of the normal recording area 305 is changed to the dot arrangement pattern of the outside-paper-end recording area 302, the transition can be performed while the difference in image quality becomes inconspicuous by performing recording with the ink droplets having different sizes.

As described above, in the recording apparatus which can eject the ink droplets having different sizes, the recording is performed by selecting the size of the ink droplet used for the recording in accordance with each area of the recording area including the recording medium, which allows the generation of the mist to be decreased in the vicinity of the end portions of the recording medium while the recording image is maintained at high quality. The recording is performed with the smaller ink droplet in order to give a high priority to the image quality, in the normal recording area 305, such as the present embodiment, which occupies the dominant portion of the recording medium. On the other hand, in the vicinity of the end portions of the recording medium in which the image quality is not so important, the recording is performed with the larger ink droplet while the ratio of the recording performed with the smaller ink droplet is decreased, which allows the generation of the mist to be decreased although the image quality is slightly decreased in the vicinity of the end portions of the recording medium. The inside of the recording apparatus can be prevented from becoming soiled by the ink, and the transfer of the soil from the recording apparatus to the recording medium can be reduced.

Figure 9:
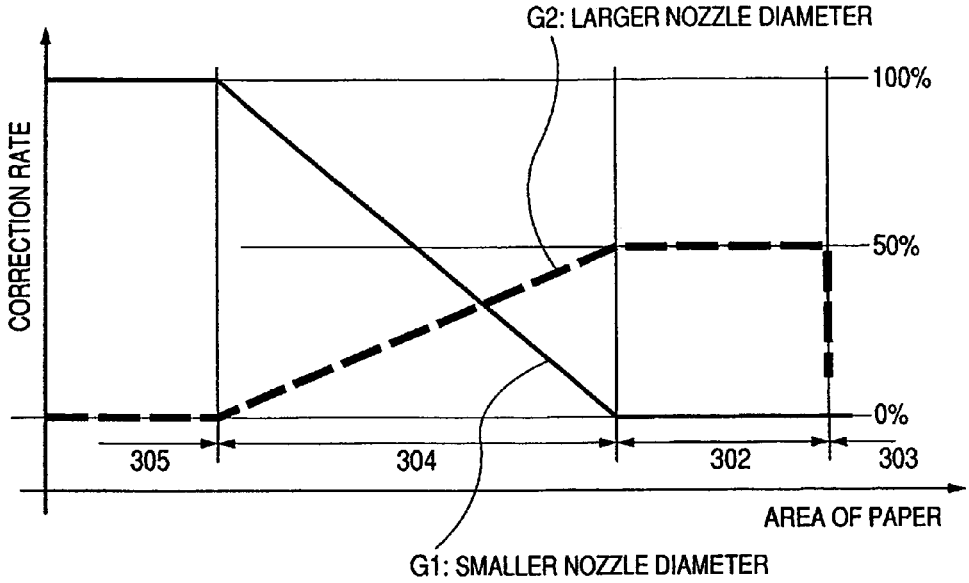
FIG. 9 shows ratios recorded by the larger ink droplet and the smaller ink droplet in each area in the second embodiment.

The image data transmitted from the host computer is corrected in each area so that the optimum recording operation is performed. Similarly to the first embodiment, the recording data correction circuit is used in the correction method. FIG. 9 shows the ratios recorded by the larger ink droplet and the smaller ink droplet in each area from the normal recording area 305 to the outside-paper area 303 in the embodiment. Even in the embodiment, the 100% recording by the smaller ink droplet is equal to the 50% recording by the larger ink droplet in density.

According to the embodiment, when the recording is performed to each area of the recording medium in the recording apparatus which can eject the ink droplets having the different sizes, since the size of the ink droplet used for the recording is selected in accordance with ease of the generation of the mist, the high-quality image can be recorded and the generation of the mist can be reduced.

Figure 10:
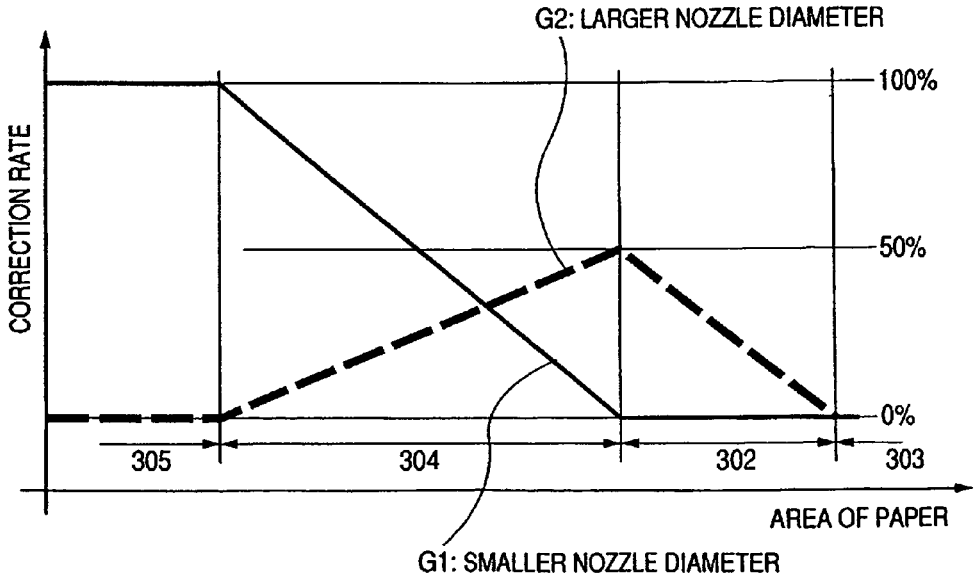
FIG. 10 shows another example of the ratios recorded by the larger ink droplet and the smaller ink droplet in each area in the second embodiment.
Figure 11:
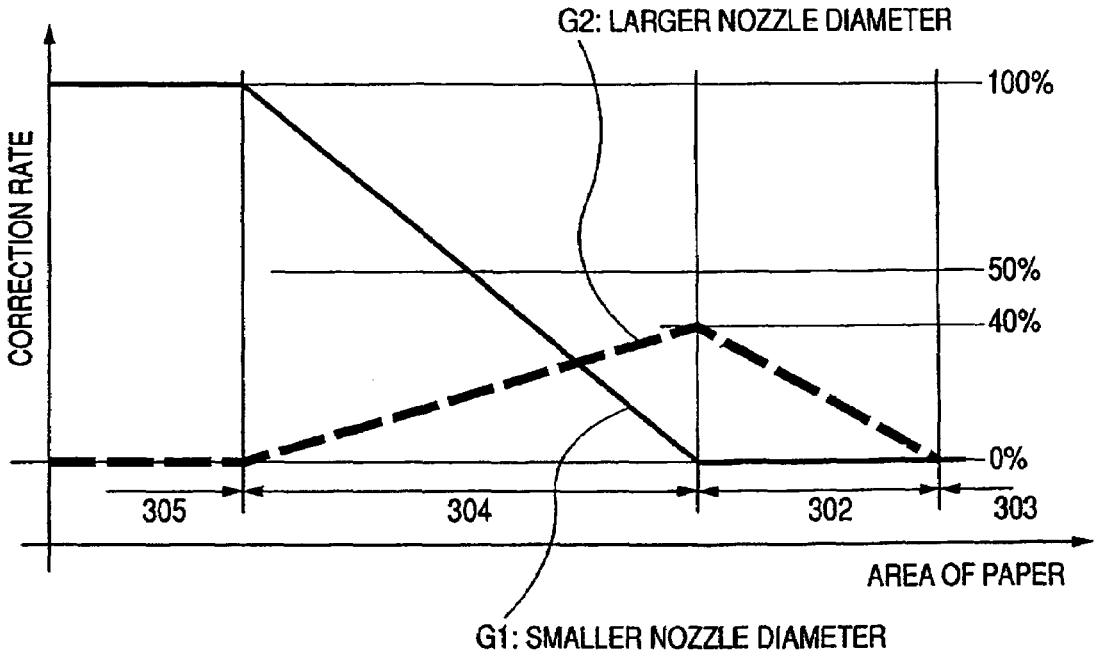
FIG. 11 shows another example of the ratios recorded by the larger ink droplet and the smaller ink droplet in each area in the second embodiment.

In addition to the above-described image data correction, it is also possible to perform the corrections shown in FIGS. 10 and 11.

In FIGS. 10 and 11, the ratio of recording using the larger ink droplet is changed in the outside-paper-end recording area 302. That is, the appearance probability of the larger ink droplet is linearly changed so that the appearance probability is set to 50% at the beginning of the outside-paper-end recording area 302 and set to 0% at the end of the outside-paper-end recording area 302. The outside-paper-end recording area 302 which is of the area outside the recording medium 13 is one which is provided in order to prevent the generation of the blank area when the printing is not performed due to the error of the size of the paper or the error caused by the conveying performance. Even if the larger ink droplet is used, sometimes the ejection of the ink droplet generates the mist in the outside-paper end portion recording area 302. Therefore, 50% larger ink droplet is ejected in the vicinity of the recording medium, and the ejection ratio of the ink droplet is gradually decreased as the recording head is separated from the recording medium, which allows the generation of the mist to be decreased. Since the amount of consumption of the ink droplet in the cases shown in FIGS. 10 and 11 is smaller than that of the case in which the 50% larger ink droplet is ejected through the outside-paper-end recording area 302, the amount of ink necessary for the recording can be reduced.

In the embodiment, the image data is also corrected by using the recording data correction circuit so that the recording is performed with the ink droplet having the appropriate size in accordance with each recording area. However, when the binary recording data corresponding to each nozzle of the recording head is generated based on the multilevel image data transmitted from the host computer by referring to an index table, the recording data can be generated without using the recording data correction circuit by equipping the recording apparatus with the index table corresponding to each area.

Although the embodiment has the configuration in which the frameless recording is performed, the embodiment can be also applied to the recording in which the small margin is left in the end portions of the recording medium and the recording in which the margin is eliminated only in the predetermined end portion of the recording medium. The recording in the vicinity of the end portion of the recording medium is larger than the recording in the central portion of the recording medium in the influence of the mist on the recording apparatus. In the recording in the central portion of the recording medium, the mist generated in the predetermined recording scan adheres to the recording medium in the next recording scan or the subsequent recording scan after diffusing in the recording apparatus for a while. However, the mist generated in the recording of the end portion of the recording medium, particularly the rear end portion or the right and left end portions adheres to the inside of the recording apparatus, because the recording medium is discharged after the mist diffuses in the recording apparatus. Thus, when the ink droplet is ejected on the same condition in each recording scan, it is considered that the same amount of mist is generated. However, since there is the difference between adhesion to the recording medium and the adhesion to the inside of the recording apparatus, the influence of the mist generated in recording the central portion of the recording medium is larger than that of the mist generated in recording the end portion.

Although the embodiment has the configuration in which the generation of the mist is decreased in the area in the vicinity of the end portion of the recording medium by changing the appearance probability of the dot formation in accordance with each area, it is also possible to form the configuration in which recording duty is changed. In the array of the dots formed on the recording medium, the same result as the embodiment can be also obtained by changing the recording duty. When the recording duty is gradually decreased from the normal recording area to the area in the vicinity of the end portion of the recording medium, a border emerging by the difference in image quality in each area becomes ambiguous and gradation is improved.

Third Embodiment

While the examples in which the recording is performed only with the smaller ink droplet in the normal recording areas 205 and 305 were shown in the first and second embodiments, an example in which the recording is performed by mixing the smaller ink droplet with the larger ink droplet even in the normal recording area is shown in a third embodiment.

Figure 12:
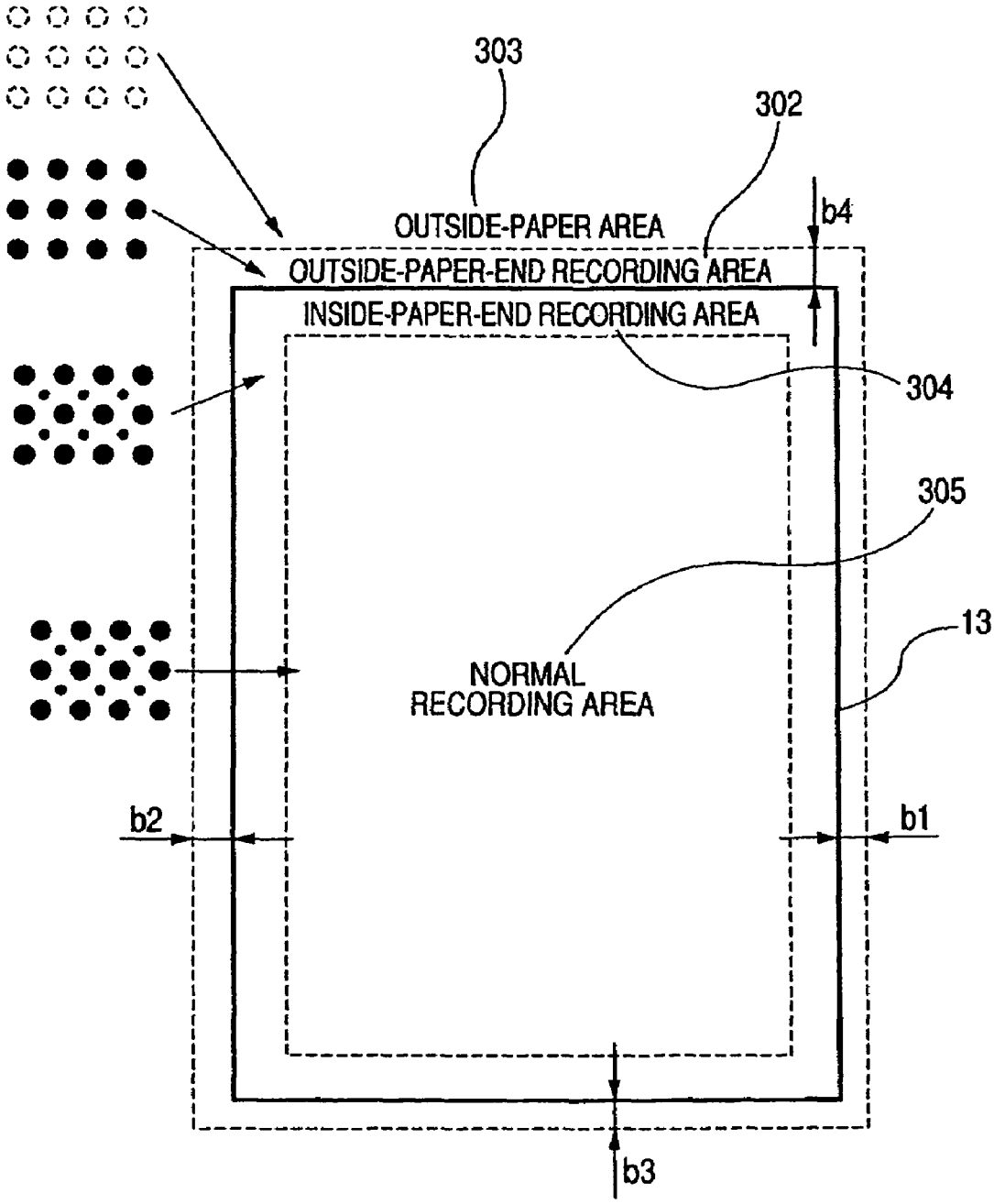
FIG. 12 is a schematic diagram showing an example of the recording method in a third embodiment.
Figure 13:
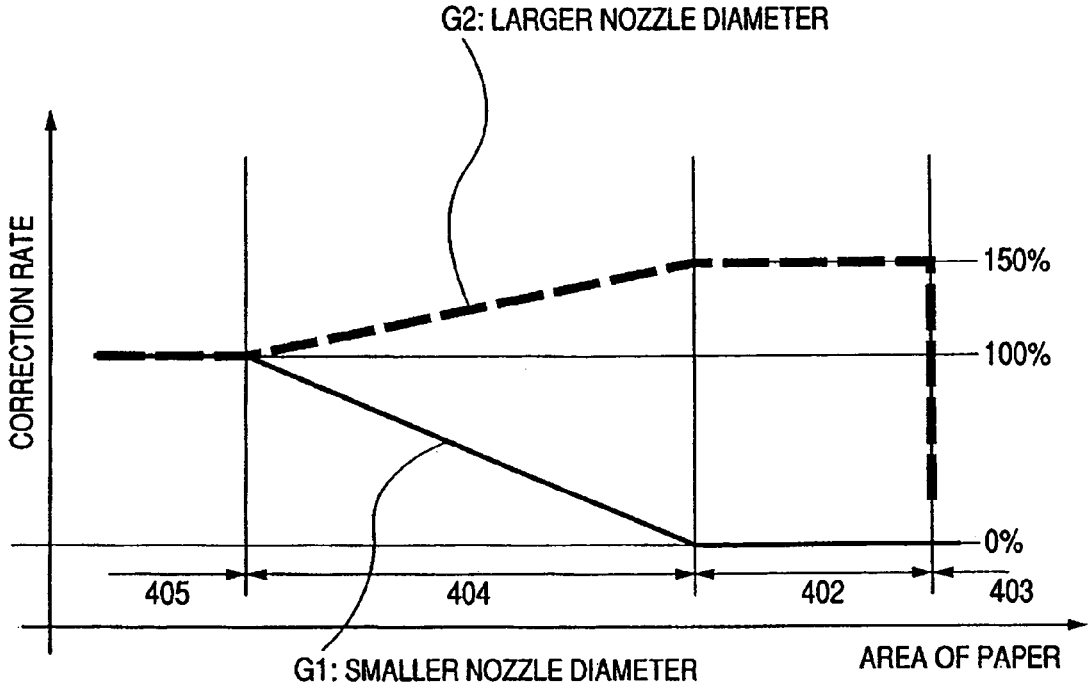
FIG. 13 shows ratios recorded by the larger ink droplet and the smaller ink droplet in each area in the third embodiment.

FIG. 12 is a schematic diagram showing the recording method in the third embodiment, and FIG. 13 shows the ratios recorded by the larger ink droplet and the smaller ink droplet in each area.

In the third embodiment, the same effect as the second embodiment can be also obtained. Further, in accordance with the third embodiment, because the recording speed can be improved when compared with the second embodiment although the quality of the recording image is slightly decreased when compared with the second embodiment, it is possible to provide the recording apparatus having both the improved image quality and the higher recording speed.

Although the recording method in which the smaller ink droplet is never ejected in the recording area outside the recording medium in the first to third embodiments, it is also possible to form the configuration in which the area outside the recording medium is further divided and the recording is performed with the smaller ink droplet at low ratio in the areas nearest to the recording medium. This allows the image quality to be improved in the vicinity of the end portion of the recording medium when the frameless recording is performed.

Other Embodiment

In the above-described embodiments, when the ratio of the recording by the smaller ink droplet is decreased, the ratio of the recording by the larger ink droplet is increased in order to maintain the density of the recording image. However, in order to further decrease the mist or to improve the decrease in image quality caused by the shift of the impact position, there is the method of not maintaining the density of the recording image. For example, the recording is performed by using both the larger ink droplet and the smaller ink droplet in the normal recording area, and, in the area near the end portion of the recording medium, it is possible that the ratio of the larger ink droplet is equal to the normal recording area and the ratio of the smaller ink droplet is decreased. In the area near the end portion of the recording medium, it is also possible that the recording is performed only with the larger ink droplet, however, the ratio of the larger ink droplet is equal to the normal recording area. In these cases, although the density of the recording image is decreased in the vicinity of the end portion of the recording medium, the generation of the mist can be further decreased. Further, since the ratio of the ejection of the smaller ink droplet is decreased in the end portion of the recording medium, the decrease in image quality caused by the shift of the impact position can be also decreased.

In adopting process black in which the pixel of black is expressed by yellow ink, magenta ink, and cyan ink, because each one pixel of the yellow ink, the magenta ink, and the cyan ink is ejected to the one black pixel, the amount of ink droplets ejected to one pixel is increased, which leads to the increase in generation of the mist. Therefore, when the black pixel is expressed by adopting process black in the area near the end portion of the recording medium, it is preferable that the appearance probability of the black pixel is set to the value lower than that of the appearance probability of other color pixels. In the recording apparatus having ink such as photoblack ink which can replace the black ink, it is preferable that the image is formed not with process black but with the photoblack ink.

It is possible to perform the recording by selecting the recording method from the recording methods of the embodiments of the invention in accordance with the type of recording medium or a recording mode. It is also possible to form the configuration in which the user selects the recording method from the recording methods of the embodiments of the invention.

What is claimed is:

1. A recording method for recording an image on a recording medium by using a recording head capable of ejecting a first ink droplet and a second ink droplet of a size smaller than that of the first ink droplet, said method comprising the steps of:

generating image data, corresponding to a first region including a neighborhood of an end of the recording medium, for allowing ejection of the first ink droplet without ejection of the second ink droplet to the first region;

generating image data, corresponding to a second region including a central portion of the recording medium, for allowing ejection of the second ink droplet without ejection of the first ink droplet to the second region;

causing the recording head to eject the first ink droplet to the first region based on the image data corresponding to the first region; and causing the recording head to eject the second ink droplet to the second region based on the image data corresponding to the second region.

2. A recording method according to claim 1, wherein the first region includes a region outside of the recording medium.

3. A recording method according to claim 1, wherein the first region includes a region on the recording medium.

4. A recording method according to claim 1, further comprising the steps of:

generating image data, corresponding to a third region between the first region and the second region, for allowing ejection of the first and second ink droplets to the third region; and causing the recording head to eject the first and second ink droplets to the third region based on the image data corresponding to the third region.

5. A recording method for recording an image on a recording medium by using a recording head capable of ejecting a first ink droplet and a second ink droplet of a size smaller than that of the first ink droplet, said method comprising the steps of:

generating image data, corresponding to a first region outside of the recording medium, for allowing ejection of the first ink droplet without ejection of the second ink droplet to the first region;

generating image data, corresponding to a second region including a central portion of the recording medium, for allowing ejection of the second ink droplet without ejection of the first ink droplet to the second region;

causing the recording head to eject the first ink droplet to the first region based on the image data corresponding to the first region; and causing the recording head to eject the second ink droplet to the second region based on the image data corresponding to the second region.

6. A recording method according to claim 5, further comprising the steps of:

generating image data, corresponding to a third region between the first region and the second region, for allowing ejection of the first and second ink droplets to the third region; and causing the recording head to eject the first and second ink droplets to the third region based on the image data corresponding to the third region.

* * * * *